US006415037B1

(12) United States Patent
Wang

(10) Patent No.: US 6,415,037 B1
(45) Date of Patent: Jul. 2, 2002

(54) SPEAKER AND THE MANUFACTURING METHOD THEREOF

(75) Inventor: Chao-Lang Wang, Taipei (TW)

(73) Assignee: Elecinic Corp., Taipei (TW)

( * ) Notice: Subject to any disclaimer, the term of this patent is extended or adjusted under 35 U.S.C. 154(b) by 0 days.

(21) Appl. No.: 09/692,440

(22) Filed: Oct. 20, 2000

(51) Int. Cl.[7] ..... H04R 25/00
(52) U.S. Cl. ..... 381/418; 381/417; 381/420
(58) Field of Search ..... 381/412, 414, 381/417, 418, 419, 420, 421, 422, FOR 159, FOR 160, 406, 407, 396; 335/222, 229

(56) References Cited

U.S. PATENT DOCUMENTS 4,000,381 A * 12/1976 Plice et al. ..... 381/418
4,540,975 A * 9/1985 Kobayashi ..... 381/418
5,809,157 A * 9/1998 Grumazescu ..... 381/420

* cited by examiner

*Primary Examiner*—Huyen Le
(74) *Attorney, Agent, or Firm*—Bacon & Thomas, PLLC

(57) ABSTRACT

A speaker and the manufacturing method thereof is disclosed wherein a diaphragm is enclosed by the peripheral frame, a resonant space is in the center enclosed by frame and diaphragm, and a winding is around a center seat. Winding is excited to generate varying magnetic lines for generating a continuous attraction-repulsion effect in the magnetic member when an electric current is flowed through, thereby vertically sliding the magnetic member to cause the diaphragm to generate sound. This can significantly reduce the thickness, simplify assembly, reduce manufacturing cost, increase the travel of diaphragm, significantly enhance the low-frequency characteristics, and increase power of speaker.

4 Claims, 5 Drawing Sheets

SPEAKER AND THE MANUFACTURING METHOD THEREOF

FIELD OF THE INVENTION

The present invention relates to a speaker, and more particularly to an improved speaker and the manufacturing method thereof, wherein winding is disposed and fixed onto the central position of the frame of speaker and is excited by electric current to generate varying magnetic lines for having a continuous attraction-repulsion effect there between with the magnetic member disposed at the corresponding position of the diaphragm of speaker, and thereby vertically sliding the magnetic member to cause the diaphragm to generate sound.

BACKGROUND OF THE INVENTION

Conventionally, speakers have been used widely in our daily life for about one hundred years. For example, a speaker is installed in a broadcasting system in a public place (such as railroad station, auditorium or the like), a warning device of motor vehicle, radio, TV, and Hi-Fi system etc. In view of the above, speakers really play an important role in the modern society.

The progress of electronic industry and material science is significant in recent years. A variety of electronic products have been commercially available due to the development of novel electronic components and manufacturing process. Such electronic products have the advantages of low manufacturing cost, high performance, and high quality. In addition, the progress of semi conductor manufacturing process has resulted in the micronization of semi conductor device which in turn has replaced the traditional electronic devices. Moreover, the market trend and demand of slim, light weight, and mini-sized electronic products has become dominant. Such significant progress has improved the convenience in use and portability of the electronic products. For example, "Walkman" and mini Hi-Fi are some of the typical consumer electronic products having the features of cheap and high quality being affordable by ordinary people. It is understood that electronic equipment, used for controlling the sound effect in the above consumer electronic products such as typical audio-video equipment and multimedia equipment, has been continuously reduced in size (i.e., miniaturized). However, the speaker mounted therein for outputting sound is still conventional bulky one, thus inhibiting the reduction of size and causing a bottle neck on the progress of audio quality and volume of such typical consuming electronic products which is difficult to be overcome by prior art techniques.

A conventional cone-shaped speaker 10 construction is shown in FIG. 1, which comprises a metal frame 11 in the periphery, a recessed resonant space 12 in the center enclosed by the metal frame 11, a diaphragm 13 enclosed by the metal frame 11 being recessed on top of the resonant space 12, a slidable sleeve 14 having one end connected to the center of diaphragm 13, a winding 15 wound around the other end of sleeve 14, a circular corrugated damping film 16 around the sleeve 14 between the diaphragm 13 and winding 15, the damping film 16 being extended radially such that the outer circumference thereof is engaged with the metal frame 11 in a predetermined position within the resonant space 12, an opening 17 on the central bottom portion of metal frame 11, a seat 18 connected to the periphery of opening 17, a first through hole 19 corresponding to adjacent opening 17 on the top side of seat 18 such that the portion of sleeve 14 having winding 15 wound thereon may insert into seat 18 through the bores of opening 17 and first through hole 19, a second through hole 20 on the bottom side of seat 18, a metal core 21 with a T-shaped cross-section having the vertical portion (i.e., post) 211 passed through the second through hole 20 and the bore of the portion of sleeve 14 having winding 15 wound thereon, and a permanent magnet 22 wound around the seat 18.

The cross-sectional view of the above mentioned conventional speaker 10 is further shown in FIG. 2. The winding 15 is excited to generate an electromagnetic effect when an electric current is flowed through. Then first magnetic lines are generated in the winding 15. Also, second magnetic lines are generated in the permanent magnet 22. Such first and second magnetic lines co-act each other to create a continuous attraction-repulsion effect. As such, the sleeve 14 having winding 15 wound thereon may slide vertically as magnitude and direction of current applied thereon being changed. In turn, the diaphragm 13 is vibrated to generate sound for outputting through speaker 10.

But the previous design suffered from a number of disadvantages. For example, it is difficult to reduce size. Also, the bottle neck on the progress of quality and volume of the output sound effect remains hard to be overcome. The reasons for causing the above disadvantages are summarized as follow:

1. The seat 18, core 21, and permanent magnet 22 of the conventional speaker 10 are bulky and mounted on the side of metal frame 11 opposite the diaphragm 13, thus inhibiting the further reduction of speaker size especially the thickness thereof.
2. The portion of sleeve 14 having winding 15 wound thereon is inserted into the seat 18 sandwiched between the limited gap between the post 211 of core 21 and the permanent magnet 22. This increases the difficulty in assembly. Also, a not precisely maintained gap may adversely affect the quality of speaker 10.
3. The position of core 21 around the seat 18 restricts the travel of sleeve 14. As such, the portion of sleeve 14 having winding 15 wound thereon may collide core 21 when speaker 10 outputs high-power low-frequency sound waves. Such collision may deform sleeve 14 after a predetermined time of use, thereby degrading the output sound quality of speaker 10.
4. There is an opening between sleeve 14 and diaphragm 13. As such, a dust cover 23 is provided on the opening for preventing dust and/or foreign objects from entering into sleeve 14 to accumulate on the gap between the sleeve 14 and post 211 of core 21. Otherwise, it may restrict the travel of sleeve 14 as illustrated in FIGS. 1 and 2.

SUMMARY OF THE INVENTION

In order to overcome the above drawbacks of prior art, the present invention provides an improved speaker and the manufacturing method thereof wherein a diaphragm is enclosed by the peripheral frame, a resonant space is in the center enclosed by frame and diaphragm, and a winding is around a center seat. The winding is excited by electric current flowed through to generate varying magnetic lines for creating a continuous attraction-repulsion effect there between with a magnetic member disposed at the corresponding position of the diaphragm, thereby vertically sliding the magnetic member to cause the diaphragm to generate sound.

In one aspect of the present invention a magnetic member is directly or indirectly fixed on the center of diaphragm such that the space occupied by the conventional seat, metal core, and permanent magnet is reduced, thereby significantly reducing the thickness of speaker.

In another aspect of the present invention winding is fixed on frame corresponding to the center of diaphragm such that a continuous attraction-repulsion effect is occurred on the magnetic member when the winding is excited which in turn vibrates the diaphragm to generate sound. This has the advantages of simplifying assembly, reducing manufacturing cost, increasing the travel of diaphragm, preventing distortion, and significantly enhancing the low-frequency characteristics and increasing power.

In still another aspect of the present invention a magnetic member is directly fixed on the center of diaphragm or indirectly fixed on the center of diaphragm through a slidable sleeve such that dust and/or foreign objects are prevented from entering into the gap between the winding and magnetic member through the center of diaphragm or the bore of slidable sleeve, thereby eliminating the provision of dust cover and un-restraining the possible travel of slidable sleeve.

The above and other objects, features and advantages of the present invention will become apparent from the following detailed description taken with the accompanying drawings.

DESCRIPTION OF THE NUMBERS ON THE DRAWINGS

| | | | |
|---|---|---|---|
| Speaker | 30 | Metal frame | 31 |
| Diaphragm | 32 | Resonant | 33 |
| Winding | 34 | Magnetic member | 35 |

DETAILED DESCRIPTION OF THE PREFERRED EMBODIMENTS

Figure 1:
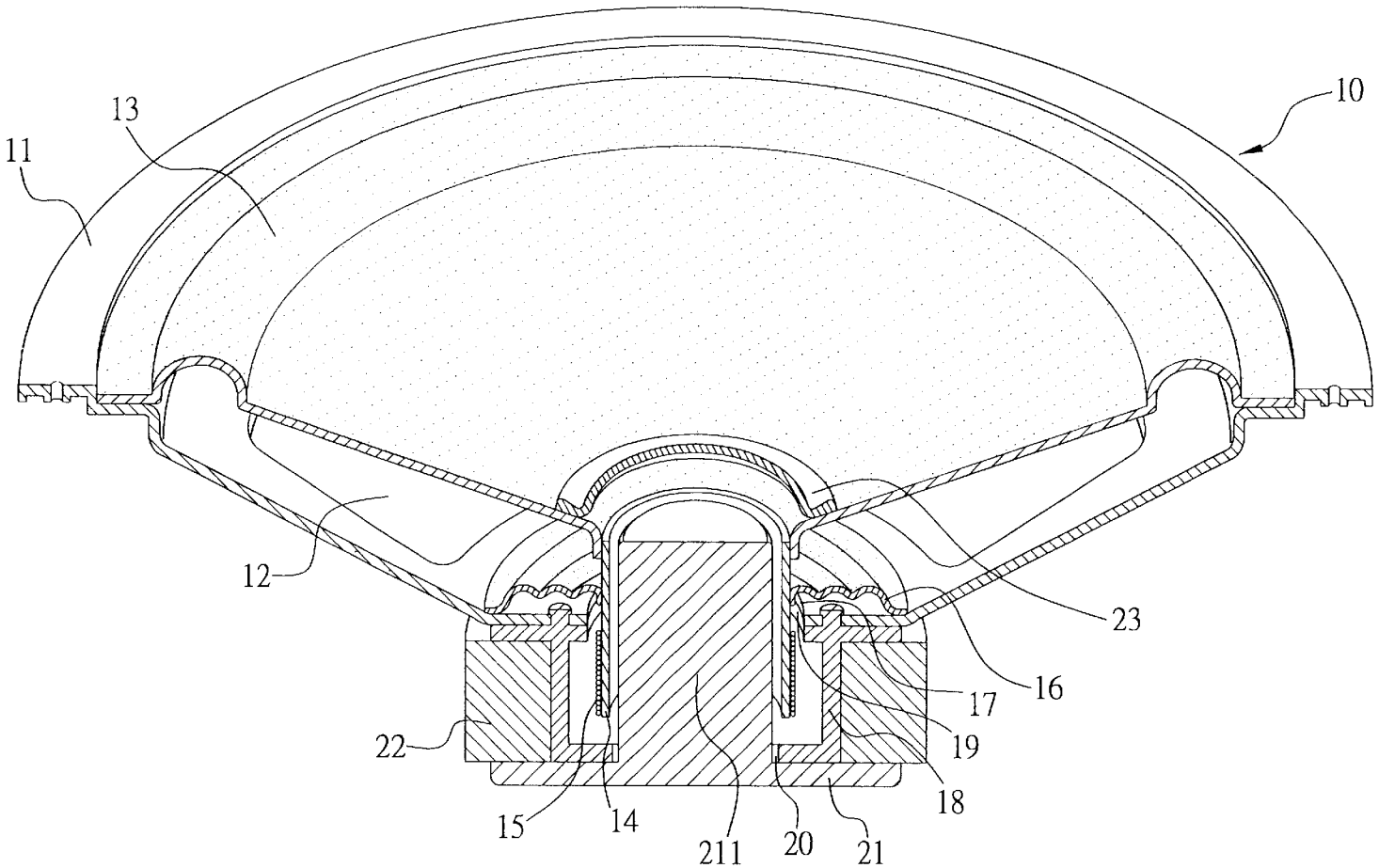
FIG. 1 PRIOR ART
FIG. 1 is a cross-sectional view of a speaker according to the previous design.
Figure 2:
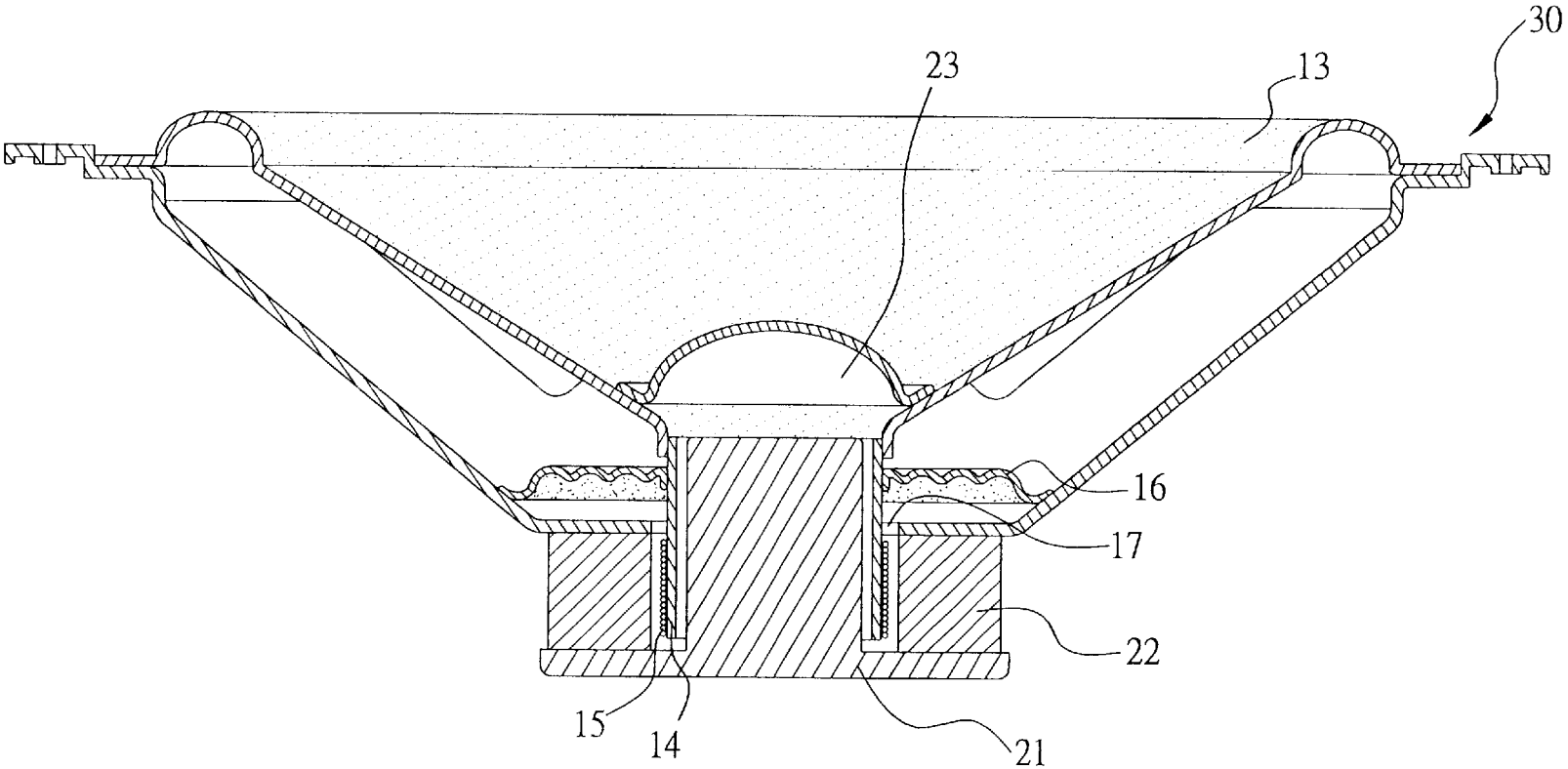
FIG. 2 PRIOR ART
FIG. 2 is another cross-sectional view of the speaker shown in FIG. 1 according to the previous design.
Figure 3:
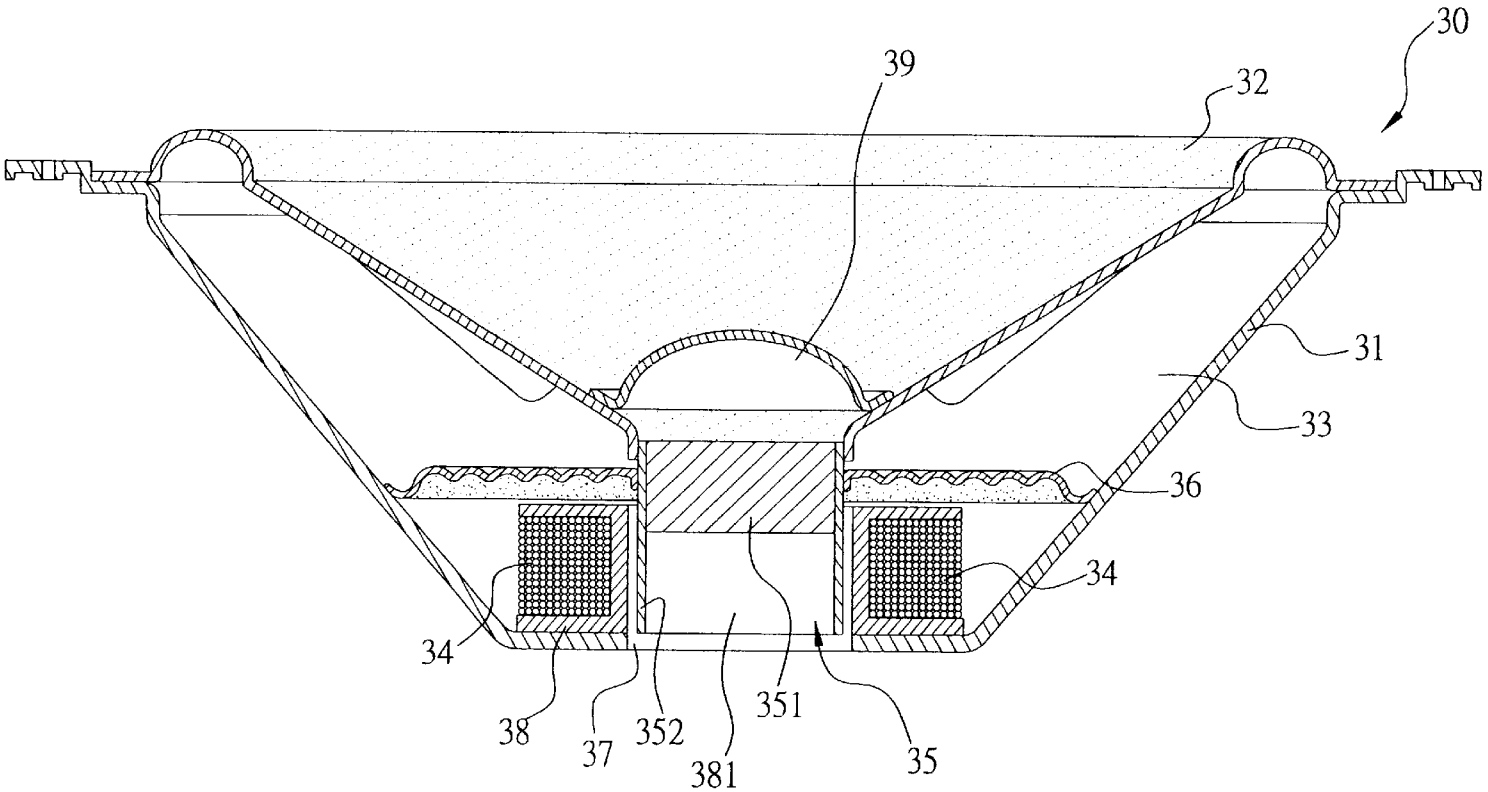
FIG. 3 is a cross-sectional view of a first preferred embodiment of speaker according to the present invention.
Figure 4:
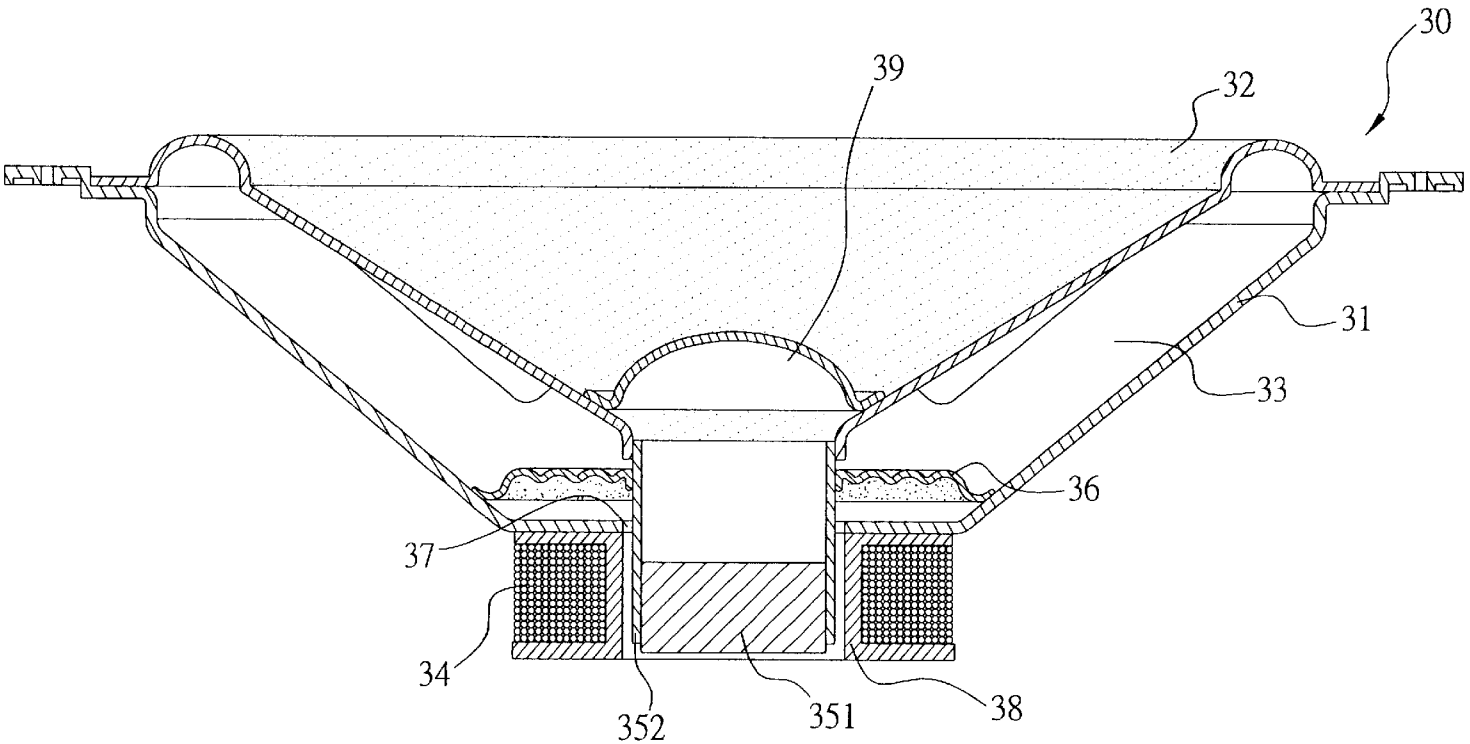
FIG. 4 is a cross-sectional view of a second preferred embodiment of speaker according to the present invention.
Figure 5:
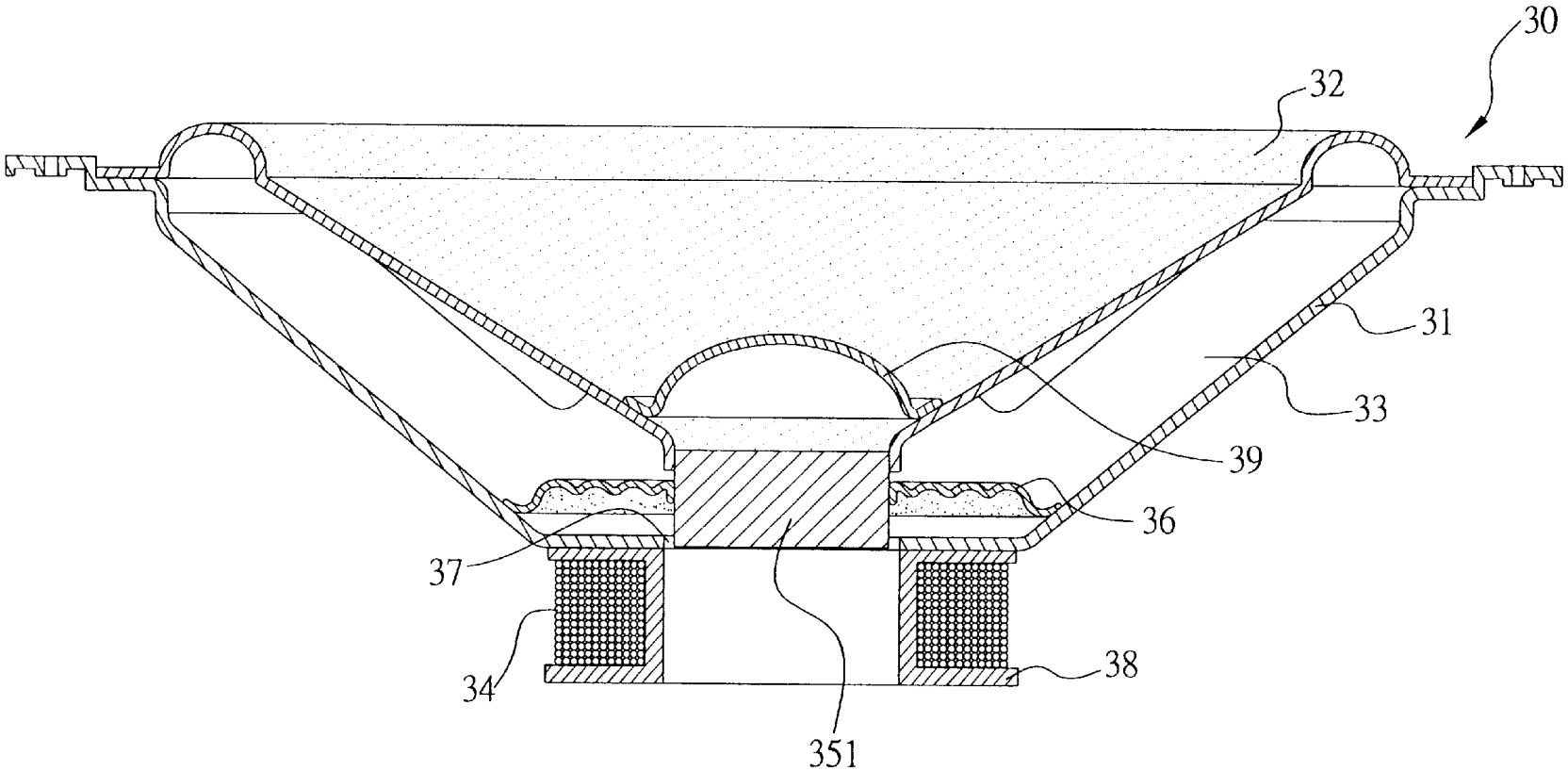
FIG. 5 is a cross-sectional view of a third preferred embodiment of speaker according to the present invention.

Referring to FIGS. 3, 4 and 5, there is shown a first preferred embodiment of speaker 30 according to the invention. The speaker 30 comprises a metal frame 31 in the periphery, a diaphragm 32 enclosed by the peripheral frame 31, a resonant space 33 in the center enclosed by frame 31 and diaphragm 32, a winding 34 in the center, and a cylindrical magnetic member 35 on the center wherein the winding 34 is excited to generate magnetic lines in the center when an electric current is flowed through. Then a continuous attraction-repulsion effect is generated in the magnetic member 35 corresponding to the winding 34. In turn, the diaphragm 32 is vibrated to generate sound for outputting through the speaker 30.

Referring to FIG. 3 specifically, there is shown a first preferred embodiment of the invention. Speaker 30 comprises a metal frame 31 in the periphery, a recessed resonant space 33 in the center enclosed by frame 31, a diaphragm 32 enclosed by frame 31 extended toward the resonant space 33, a winding 34 in the center, a cylindrical magnetic member 35 on the center, a through hole 37 on the bottom center of resonant space 33, a seat 38 connected to the periphery of through hole 37, and a bore 381 passed through the center of seat 38 having an inner diameter conformed to that of through hole 37. The sizes and locations of bore 381 and through hole 37 are designed to permit the magnetic member 35 to pass and freely slide therein.

In this embodiment, the winding 34 is excited in the center when an electric current is flowed through. Then an electromagnetic effect is occurred in the bore 381 of seat 38 for generating first magnetic lines. Also, second magnetic lines are generated in magnetic member 35. These two magnetic lines co-act each other to create a continuous attraction-repulsion effect. As such, the magnetic member 35 may slide vertically as magnitude and direction of current applied on the winding 34 being changed. In turn, the diaphragm 32 is vibrated to generate sound for outputting through speaker 30.

Referring to FIG. 4 specifically, there is shown a second preferred embodiment of speaker according to the invention. The seat 38 is connected to the periphery of through hole 37 while under the bottom of frame 31 opposite to resonant space 33. A bore 381 is passed through the center of seat 38 having an inner diameter conformed to that of through hole 37. The sizes and locations of bore 381 and through hole 37 are designed to permit magnetic member 35 to pass and freely slide therein. As such, in this embodiment, the winding 34 is excited in the center when an electric current is flowed through. Then an electromagnetic effect is occurred in the bore 381 of seat 38 for generating first magnetic lines. Also, second magnetic lines are generated in magnetic member 35. These two magnetic lines co-act each other to create a continuous attraction-repulsion effect. As such, the magnetic member 35 may slide vertically as magnitude and direction of current applied on the winding 34 being changed. In turn, the diaphragm 32 is vibrated to generate sound for outputting through speaker 30. In this second embodiment, the magnetic member 35 is a permanent magnet 351 having high magnetism fixed on the center of diaphragm 32.

Referring to FIG. 5 specifically in conjunction with FIGS. 3 and 4, there is shown a third preferred embodiment of speaker according to the invention. The magnetic member 35 comprises a slidable sleeve 352 and a permanent magnet 351 having high magnetism. One end of sleeve 352 is fixed on the center of diaphragm 32 while the other end is slidably extended into the bore 381 and through hole 37 for increasing the stability of magnetic member 35 while moving. Permanent magnet 351 is mounted in any of suitable positions in the center of sleeve 352 as long as electromagnetic effect is occurred in the winding.

Further, a circular corrugated damping film 36 is provided around magnetic member 35 (or sleeve 352) adjacent to the diaphragm 32. The outer circumference of damping film 36 is engaged with the frame 31 in a predetermined position within the resonant space 33. This damping film 36 may increase the damping effect of diaphragm 32 and magnetic member 35 for facilitating operator to adjust quality and volume of speaker 30.

Since the magnetic member 35 can be directly or indirectly fixed on the center of diaphragm 32 such that the space occupied by conventional seat, metal core, and permanent magnet is reduced, thereby significantly reducing the thickness of speaker 30. Further, the winding 34 is fixed on center of frame 31 such that a continuous attraction-repulsion effect is occurred on magnetic member 35 when the winding 34 is excited which in turn vibrates the diaphragm 32 to generate sound. This can simplify assembly, reduce manufacturing cost, increase the travel of diaphragm 32, prevent distortion, and significantly enhance the low-frequency characteristics and increase power of speaker. Furthermore, the magnetic member 35 is directly fixed on the center of diaphragm 32 or indirectly fixed on the center of diaphragm 32 through a slidable sleeve 352 such that dust and/or foreign objects are prevented from entering into the gap between the winding 34 and magnetic member 35 through the center of diaphragm 32 or the bore of slidable sleeve 352, thereby eliminating the provision of dust cover 39 and unrestraining the possible travel of slidable sleeve 352.

While the invention has been described by means of specific embodiments, numerous modifications and variations could be made thereto by those skilled in the art without departing from the scope of protection and spirit of the present invention set forth in the claims.

What is claimed is:

1. A speaker device comprising:

(a) a frame in a periphery;

(b) a diaphragm enclosed by the frame on one side;

(c) a resonant space enclosed by the frame and the diaphragm, a through hole on the bottom center of the resonant space, a seat connected to a periphery of the through hole, and a bore passed through the center of the seat and having an inner diameter conforming to that of the through hole for permitting the magnetic member to pass and slide in the through hole and the bore;

(d) a magnetic member in the center of the diaphragm, the magnetic member including a slidable sleeve and a permanent magnet having high magnetism, a first end of the sleeve being fixed on the center of the diaphragm, and a second end of the sleeve extending into the bore and the through hole for freely sliding therein;

(e) a winding around the center of the frame; and (f) wherein the winding is excited to generate an electromagnetic effect in the center when an electric current is flowed therethrough, which in turn generates a continuous attraction-repulsion effect in the magnetic member, thereby vertically sliding the magnetic member to cause the diaphragm to generate sound.

2. The speaker device of claim 1, wherein the permanent magnet is mounted in one of a plurality of positions in the center of the sleeve for causing an electromagnetic effect in the winding.

3. The speaker device of claim 1, further including a circular corrugated damping film around the sleeve adjacent the diaphragm, wherein an outer circumference of the damping film is extended to engage with the frame in a predetermined position within the resonant space.

4. The speaker device of claim 1, wherein the seat is connected to the periphery of the through hole under the bottom of the frame opposite to the resonant space.

* * * * *